United States Patent [19]

Sato et al.

[11] Patent Number: 4,924,639

[45] **Date of Patent: * May 15, 1990**

[54] METHOD FOR RESTRAINING VIBRATION OF A FLOOR AND APPARATUS THEREFOR

[75] Inventors: Takanori Sato; Kazumitsu Takanashi, both of Tokyo, Japan

[73] Assignee: Shimizu Construction Co., Ltd., Tokyo, Japan

[ * ] Notice: The portion of the term of this patent subsequent to Nov. 15, 2005 has been disclaimed.

[21] Appl. No.: 186,394

[22] Filed: Apr. 26, 1988

[30] Foreign Application Priority Data

Apr. 27, 1987 [JP] Japan ..... 62-103770
Apr. 27, 1987 [JP] Japan ..... 62-103771

[51] Int. Cl.[5] ..... E02D 27/34

[52] U.S. Cl. ..... 52/167 DF; 52/168; 52/1

[58] Field of Search ..... 52/167, 1; 5/450, 451; 405/195

[56] References Cited

U.S. PATENT DOCUMENTS

| | | | |
|---|---|---|---|
| 3,606,704 | 9/1971 | Denton | 52/167 |
| 3,736,604 | 6/1973 | Carson | 5/451 |
| 3,940,895 | 3/1976 | Yamamoto | 52/167 |
| 4,226,554 | 10/1980 | Vandiver | 405/195 |
| 4,258,516 | 3/1981 | Mori | 52/167 |
| 4,783,937 | 11/1988 | Sato | 52/167 |

FOREIGN PATENT DOCUMENTS

| | | |
|---|---|---|
| 325766 | 8/1930 | United Kingdom . |
| 710573 | 6/1954 | United Kingdom . |
| 821781 | 7/1959 | United Kingdom . |
| 854725 | 7/1960 | United Kingdom . |
| 950983 | 2/1964 | United Kingdom . |
| 946046 | 3/1964 | United Kingdom . |
| 966097 | 8/1964 | United Kingdom . |
| 999421 | 7/1965 | United Kingdom . |
| 1322807 | 7/1973 | United Kingdom . |
| 1522833 | 7/1978 | United Kingdom . |
| 2174449 | 5/1986 | United Kingdom . |
| 2194017 | 3/1988 | United Kingdom . |

*Primary Examiner*—Henry E. Raduazo
*Attorney, Agent, or Firm*—Hoffmann & Baron

[57] ABSTRACT

The present invention provides a method of restraining vibration of a floor and an apparatus therefor.

According to the method, a reservoir is attached to the floor which is supported from structural members of a floor structure and fluid is put in the reservoir. Geometry of the reservoir and depth of the fluid is determined so that sloshing natural frequency of the fluid coincides with a natural frequency of the floor in a same direction.

The vibration restraining apparatus according to the present invention is provided with a reservoir wherein a prescribed amount of liquid is retained. Natural sloshing frequency of the liquid in the reservoir is generally equal to a natural frequency of the floor structure.

As the floor vibrates because of vibration of the floor structure or vibrational source on the floor, vibrational energy of the floor is transmitted to the liquid and cause sloshing thereto. Because the sloshing natural frequency is generally equal to the natural frequency of the floor, vibrational energy of the floor is almost totally transmitted to the liquid. Consequently, vibration of the floor is restrained.

21 Claims, 12 Drawing Sheets

METHOD FOR RESTRAINING VIBRATION OF A FLOOR AND APPARATUS THEREFOR

BACKGROUND OF THE INVENTION

The present invention relates to a method and an apparatus for restraining a vibration of a floor.

Floors in a building vibrate when the building vibrates due to earthquakes, winds, traffics, and other vibration sources. Floors are induced to vibrate also because of vibration sources located on the floor. Modern buildings generally have more flexibility and less damping compared to conventional buildings by virtue of affluently flexible modern structural members and precise construction techniques. Consequently, modern buildings permit larger displacements than before, and vibration in modern buildings tend to become larger than in conventional buildings. Then, excessive vibration of floors may cause such various inconveniences and problems as misoperation of equipments installed on the floor and uncomfortable feeling of motion induced to the occupants etc. Reduction of vibration is desirable also to reduce vibrational loads exerted on the structural members of the building when the vibration source is located on the floor.

In order to resolve some of these inconveniences, present inventors have already proposed a vibration restraining apparatus for buildings by a Japanese Patent Application No. 62-241045, FIG. 1. By the Patent Application, disclosed is a vibration restraining apparatus comprising a tank and a liquid retained in the tank to be installed at a roofing of the building so as to restrain vibration of the building. As the building vibrates, vibrational energy of the building excites the liquid, having a sloshing natural frequency identical to a natural frequency of the building, to slosh in resonance with the building. Consequently, vibration of the building is restrained as the vibrational energy of the building is transmitted to the liquid. It was stated in the specification that the weight of the liquid retained in the tank had better be larger than 1% of the building so as to assure an effectiveness.

A problem as to the above-mentioned conventional apparatus and methods for restraining vibration of a building is that the apparatus requires a large space to be installed in and consequently the space is found, in general, only at the top of the building.

Another problem in conventional apparatus and methods is that a large number of such tanks have to be installed. It is because that the size of the liquid tank is relatively small in order to make the sloshing frequency identical to that of the building and because effective weight of the liquid has to be larger than 1% of that of the building. Another problem is that it is not easy to make sure that a prescribed amount of liquid is retained in each of the tanks.

On the other hand, there is a requirement to suppress vibration of a specific floor where precision instruments are installed such as computers. In some cases, vibration restraint of each floor is more effective or economic, and thus preferable.

In some other cases, vibration source is located on a specific floor and the floor had better be isolated so as not to transmit vibration to the building.

A conventional technique to reduce vibration of a floor is to support the floor from structural members of the building by resilient means. By virtue of the resilience of the support, natural frequency of the floor is lowered becomes far apart from that of the building. The support of the floor acts as a kind of isolation device.

A problem in this case is that relative displacement between the floor and the building tends to become large and cause various inconveniences on pipings and cables passing through the building and the floor. Another problem is that once a vibration occurs the vibration tends to continue long before being stabilized and give uncomfortable feeling to the occupants.

SUMMARY OF THE INVENTION

The present invention is directed to a method and an apparatus for restraining a vibration of a floor by supporting the floor by a relatively flexible support and providing the floor structure with a reservoir retaining liquid therein and adjusting a sloshing natural frequency of the liquid so that it generally coincides with a natural frequency of the floor structure.

In achieving practical application of the present invention, the vibration restraining apparatus, which is to be attached to a floor, may comprise a reservoir defining at least one chamber for retaining a liquid having a free surface.

The liquid retained in the chambers slosh as the floor vibrates. Vibrational energy of the floor is transferred to the liquid and generates sloshing thereof. As a result, vibration of the floor is restrained due to the loss of the vibration energy. Vibration of the floor is restrained most effectively when a natural frequency of the sloshing coincides with a natural frequency of the floor structure. In other words, the floor and the liquid form a unitary oscillating system, and a fundamental vibration mode of the system is a mode wherein sloshing occurs together with a displacement of the building. Eigen mode of the oscillating system, as defined in a complex space, comprises a displacement of the sloshing 90 degrees out of phase with respect to the displacement of the floor. The effect is distinct even when an effective mass of the liquid is far less than that of the floor as far as the natural frequency of the sloshing coincides with that of the floor. Displacement of the floor in the fundamental mode of the unitary oscillating system is smaller than that of the floor without the liquid. Consequently, the vibration becomes smaller when the floor is provided with the vibration restraining structure.

In a primary aspect of the invention, vibration restraining apparatus comprises (a) a prescribed dimensions and secured to the floor structure; and (b) a liquid retained in the reservoir means, having a prescribed depth and a free surface; whereby making a sloshing natural frequency of the liquid being generally equal to the dry natural frequency of the floor structure corresponding to a condition in which the reservoir means without the liquid and equipments are loaded on the floor structure. In a secondary aspect of the invention, method for restraining vibration of a floor comprises steps of (a) attaching a vibration restraining apparatus to the floor structure, the apparatus comprising a reservoir means of prescribed dimensions; and (b) providing the reservoir means with a prescribed amount of liquid so that the liquid has a prescribed depth beneath a free surface at a top thereof; whereby adjusting a sloshing natural frequency of the liquid generally equal to the dry natural frequency of the floor structure corresponding to a condition in which the reservoir means without the liquid and equipments are loaded on the floor structure.

Further objects and advantages of the present invention will appear hereinafter.

DETAILED DESCRIPTION OF THE PREFERRED EMBODIMENTS

Preferred embodiments of the present invention will now be explained in detail referring to the attached drawings.

Figure 7:
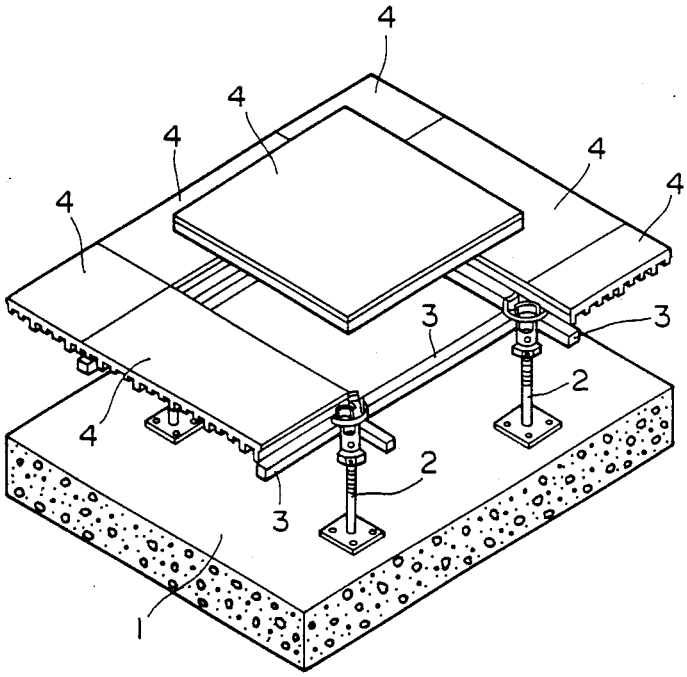
FIG. 7 is a perspective view of an example of floor structure to which the vibration restraining apparatus is attached.

FIG. 7 is a perspective view of an example of a floor structure to which a vibration restraining apparatus of the present invention is to be provided. A grid 3 is supported from a concrete slab 40 by means of floor columns 2 which are anchored into the slab 40. The grid 3 comprises longitudinal members and transversal members which are intersecting and connected to each other at their junctions. The grid 3 is connected to the floor columns 2 at the junctions. Floor panels 4 are placed on the grid generally in a detachable manner. The floor structure is one of those which are often used in computer rooms etc. in order to secure a cable space beneath the floor panel.

Figure 2:
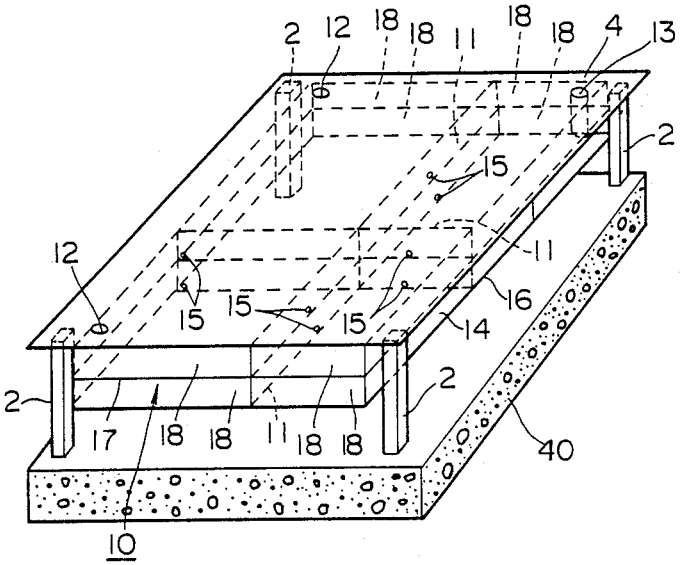
FIG. 2 shows an embodiment of a vibration restraining apparatus for a floor according to the present invention.
Figure 3:
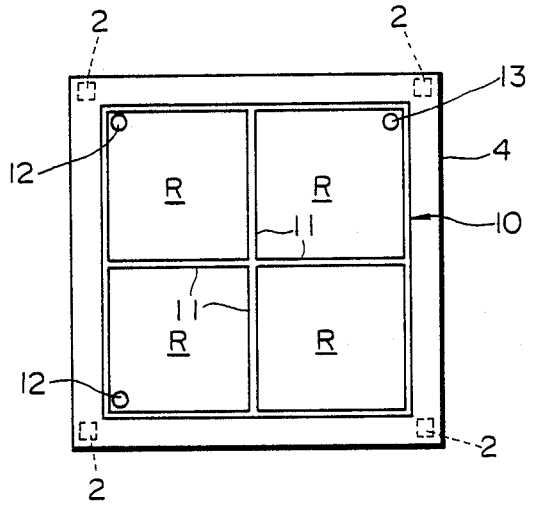
FIG. 3 is a plan view of the vibration restraining apparatus.

FIGS. 2 and 3 show a first embodiment of the vibration restraining structure according to the present invention together with a floor structure. The floor structure comprises a floor panel 4 supported from a concrete slab 1 of a building by means of four floor columns 2. Beneath the floor panel 4 is attached a vibration restraining apparatus 10. The vibration restraining apparatus 10 comprises four side walls 14 connected to each other at a pair of opposing edges to define a rectangular parallelepiped inner space, and a bottom plate 16 closing a lower end of the inner space. A lower edge of the side walls 14 is connected to each edge of the bottom plate 16. An upper edge of each of the side walls 14 is connected to a lower surface of the floor panel 4. Vertical partition walls 12 and a horizontal partition wall 17 are provided in the inner space to separate the inner space into chambers 18. Communication holes 15 are formed in the vertical separation walls 11 at a lower portion of each chamber 18 so that the chambers 18 located at a same elevation are communicating to each other through the holes 15. Inlet apertures 12 is formed in the floor panel 4 so as to supply and drain liquid, such as water, to and out of the chambers 18.

Figure 4:
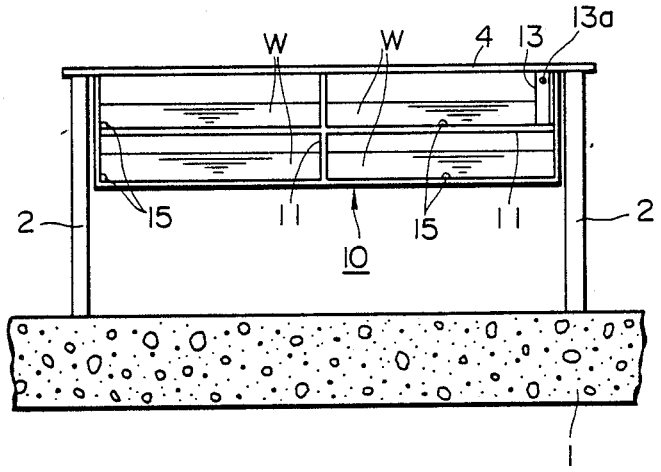
FIG. 4 is a vertical section of the vibration restraining apparatus.
Figure 5:
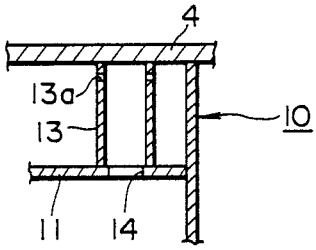
FIG. 5 is a close-up vertical section of the vibration restraining apparatus.

As shown in FIG. 4, a pipe 13 is provided in an upper chamber 18, an upper end thereof being attached to the floor panel 4, a lower end thereof being attached to the horizontal separation plate 17. A leveling aperture 13*a* is formed at a prescribed position of the pipe. A liquid feeding hole 14 is formed in the horizontal separation plate 17 closing a bottom of the tube 13. Therefore, the upper chamber 18 is communicating with a lower chamber 18 through the tube 13 by means of the leveling aperture 13*a* and the liquid feeding hole 14. FIG. 5 shows the pipe 13 in more detail.

The floor structure has a natural frequency, which is referred to as a dry natural frequency hereinafter, which is a natural frequency of the floor when equipments are installed thereon and the attached vibration restraining apparatus containing no liquid therein. The dry natural frequency is approximately determined by a total stiffness of the floor columns 2 and a total weight supported by the columns 2.

Water is supplied to the apparatus as follows.

Figure 6:
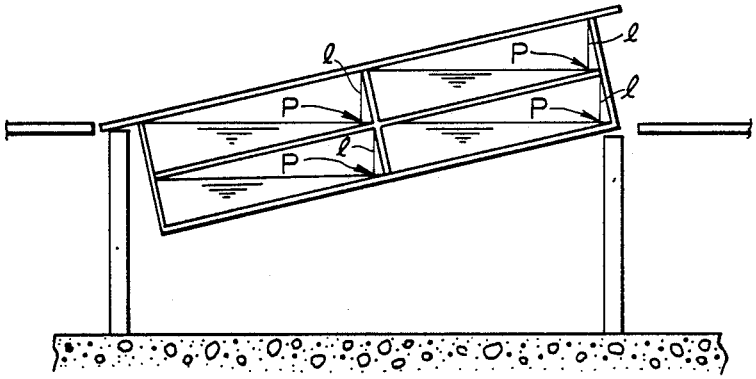
FIG. 6 shows how the amount of water retained in the vibration restraining apparatus is adjusted.

First, a prescribed amount of water is poured in the reservoir through the inlet aperture 12. The water is retained in the upper chambers 18. Then, an edge of the apparatus 10 farthest from the pipe 13 is lifted up to incline the apparatus 10. Consequently, a portion of water is drained through the pipe 13 and retained in the lower chambers, FIG. 6. By selecting the angle of inclination properly as illustrated in, the amount of water drained into the lower chambers 18 is made to be equal to that retained in upper chambers. After resetting the apparatus horizontally, water levels in the upper chambers 18 and lower chambers 18 becomes identical to each other by means of communication holes 15. The water level can be adjusted by determining selectively the amount of water poured to the reservoir and the angle to tilt the apparatus thereafter.

Dimension of the chambers 18 and depth of water retained in the chambers 18 are determined so that the sloshing natural frequency of the water is generally equal to the above-mentioned vacant natural frequency of the floor structure.

In a modified embodiment, the leveling aperture 13*a* is located at a level at which the water surface has to be maintained. In such a case, it is enough to simply pour a prescribed amount of water to the reservoir. Redundant water drips from the upper chambers 18 to the lower chambers 18 through the leveling aperture 13*a* and a prescribed amount of water is retained in both the upper and lower chambers 18 as a result.

Figure 8:
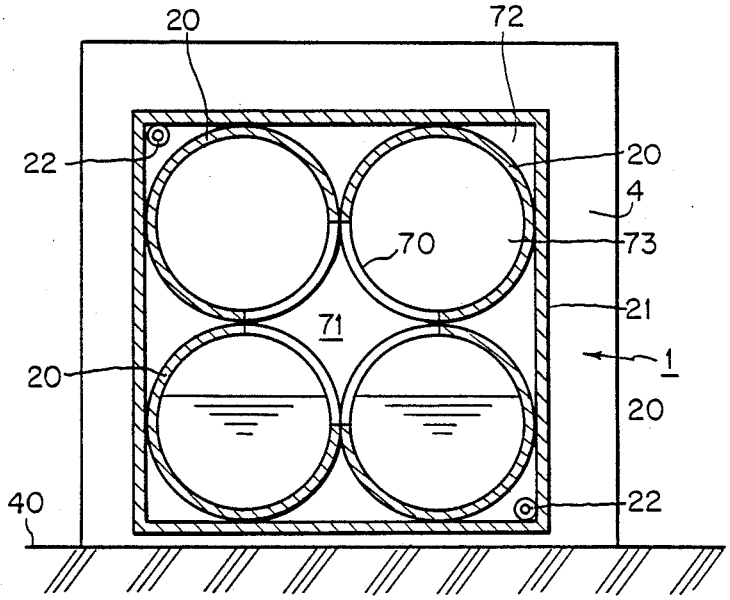
FIG. 8 is a side elevation view of a modified embodiment of the vibration restraining apparatus, vertically stood up on a floor panel.
Figure 9:
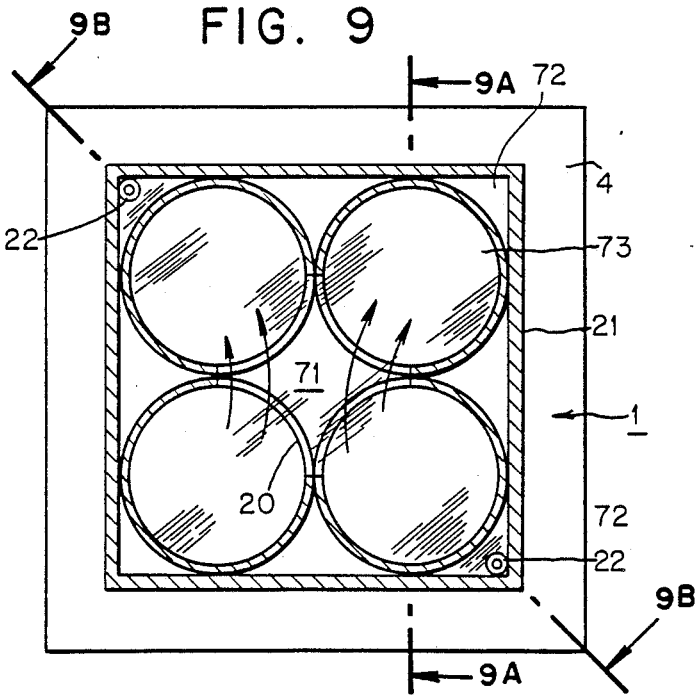
FIG. 9 is a plan view of a modified embodiment of the vibration restraining apparatus.
Figure 9A:
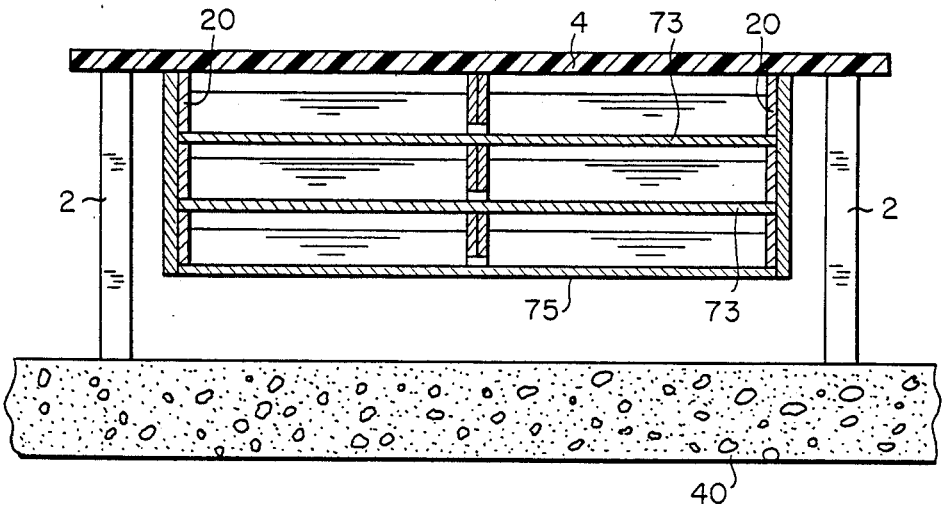
FIG. 9A is a cross-sectional view of the vibration restraining apparatus of the present invention, taken along line 9A—9A in FIG. 9.
Figure 9B:
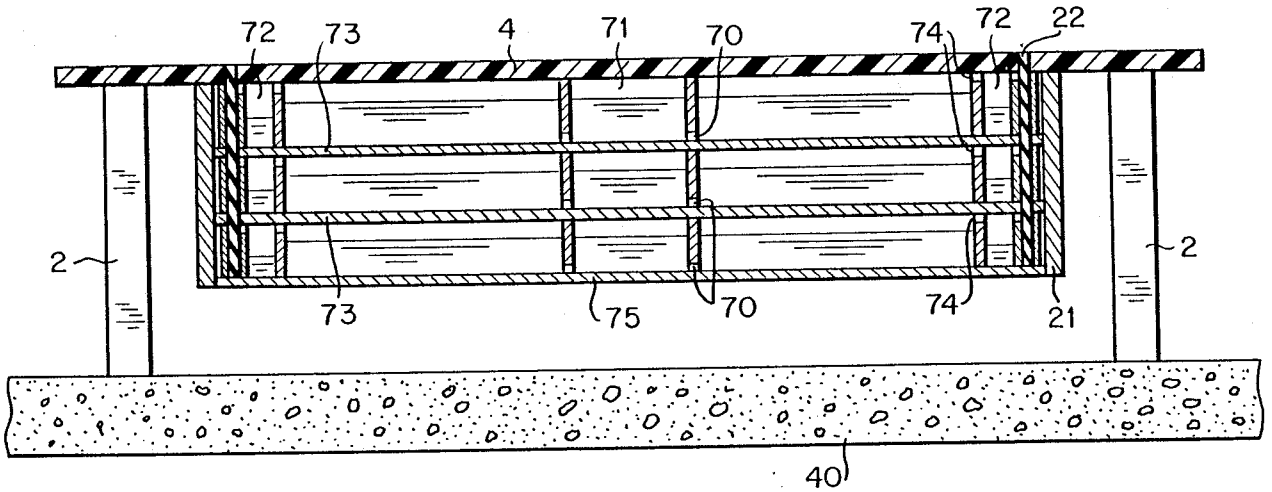
FIG. 9B is a cross-sectional view of the vibration restraining apparatus of the present invention, taken along line 9B—9B in FIG. 9.

FIGS. 8 and 9 and 9A and 9B show a further modified embodiment of the vibration restraining apparatus. In the embodiment, a rectangular side wall 21 and a plurality of cylindrical wall reservoirs 20 having a common rectangular bottom plate 75, closing their lower end, are secured to the floor panel 4. As shown in FIG. 8, wall of each reservoir 20 is in contact to each other to form a closed space 71 thereby. Inside the reservoir 20, a plurality of partition walls 73 are provided parallel to the floor panel 4. As illustrated in FIGS. 9A and 9B, each reservoir 20 has a wall surface which includes an upper and a lower end. Notably, the upper and lower ends of the cylindrical wall surface touch the floor panel 4 and the bottom partition walls 73 as shown. Thus a closed space inside the reservoir 20 is divided into a plurality of short cylindrical chambers by virtue of the partition walls 73. Wall of the cylindrical reservoir 20 has first plurality of slits 70, formed at the lower end of each chamber, opening toward the closed space 71. Each chamber is communicating with the closed space 71 through the slit 70. A wall of each reservoir 20 and a pair of intersecting tangential side walls 21 define a generally triangular prismatic closed space 72. The wall of the cylindrical reservoir 20 has a second plurality of slits 74 (not shown) at the upper part of each of the chambers through which the chambers communicate with the prismatic space 72. A feed water line 22 is provided in the prismatic space 72 so that the prismatic closed space 72 is connected to a water supply means (not shown) therethrough. At the opposite corner of the vibration restraining apparatus, another feed water line 22 is provided. The feed water lines 22 are used not only for feeding water to the apparatus 1 but also to drain water from the apparatus 1.

Way of supplying a prescribed amount of water to each of the reservoirs 20 is explained hereinafter.

First, the vibration restraining apparatus 1 is held in an upright position as shown in FIG. 8, in particular. A prescribed amount of water is supplied to the apparatus through one of the feed water lines 22. Then, the apparatus is turned down so that the horizontal partition walls become vertical. While the apparatus is at this position, as shown in FIG. 8, the water flows into half of the chambers which are lower than the other half of chambers through the plurality of second slits 74. Next, the apparatus is set up again to the upright position. The water having been retained in the lower chamber flows into the other chambers through the plurality of first slits 70. As a result, all chambers have an identical water depth, consequently, an identical sloshing natural frequency. In a still further modified embodiment, a rectangular separation wall replaces four partition walls separating inner space of reservoirs and separates the triangular prismatic spaces also. In this case, abovementioned feed water means 12 are used to provide each triangular prismatic space with water. Method of providing the apparatus with water is similar to the above case.

Preferably, flanges 64 are secured to the inner surface of the side wall 20 so as to obstruct any swirling motion of the water.

Figure 13:
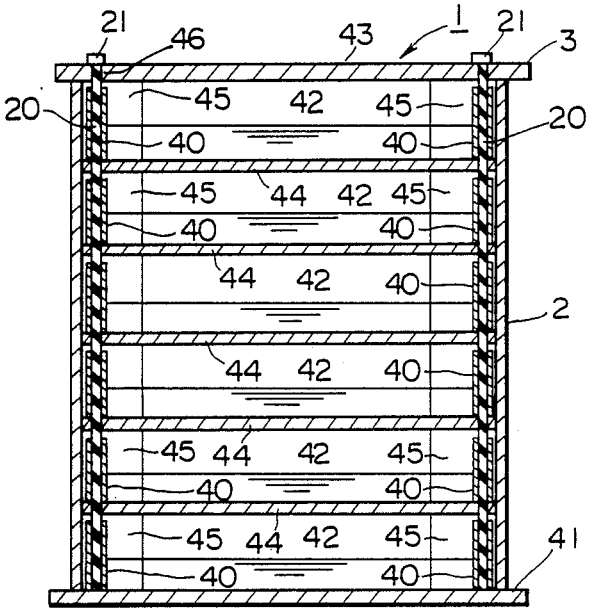
FIG. 13 shows a modified vibration restraining apparatus.
Figure 14:
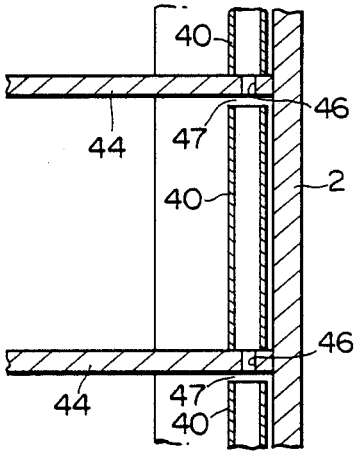
FIGS. 14 to 17 show mechanisms for feeding and draining water to and from the reservoirs.

FIGS. 13 to 17 show modified embodiments of the present invention. FIG. 13 shows a vibration restraining apparatus 1 which comprises a cylindrical side wall 40 secured to a floor panel 43 and a bottom plate 41, the wall 40 and the bottom plate 41 defining an inner cylindrical space thereby. Partition walls are provided within the inner space to define thereby chambers 42. Each separation wall 44 and the bottom plate 41 are provided with a pair of feed water apparatus 45 comprising a tubular member 40. The tubular member is attached to the partition wall 44 at its lower end. The tubular member 40 is standing as a cantilever on the attached lower end. There is a gap 47 of a prescribed distance between the upper end of the member 40 and a partition wall above the end, FIGS. 13 and 14. A feed water aperture 46 is formed in the partition walls 44 so that an inner space within the tubular member 40 is communicating with the chamber beneath the partition wall 44 to which the member 40 is attached through the aperture 46. In the floor panel 43, a feed water hole 46 is formed at a location above the tubular member 40.

Figure 15:
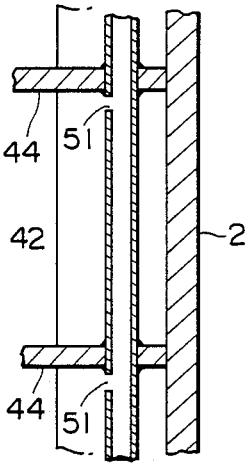

FIG. 15 shows another embodiment of the feed water apparatus which comprises a feed water line 50 passing vertically through the chambers 42. A regulation aperture 51 is formed in the feed water line 50 near an upper partition wall 40 defining each chamber 42. Same as in the above case, the inner space of the feed water line 50 communicates with the chambers 42 through the the regulation chambers 51.

For supplying the chambers 42 with prescribed amount of water, sum of the prescribed amount of water is first poured in the vibration restraining apparatus 1 through the feed water hole 46. The water is retained in a or some of the lower chambers 42. Then, the apparatus is rotated by 90 degrees so that the horizontal wall 44 is retained vertically. In the position, one of the tubular member 40 or the feed water line 50 is retained lower than a water surface. Consequently, amount of the water different from a chamber 42 to the other is regulated automatically. The vibration restraining apparatus 1 is restored. Then, the amount of water retained in the chambers 42 remains unchanged. Thus, the feed water apparatus 45 simplifies much the procedure to supply the chambers 42 with a prescribed amount of water.

Figure 16:
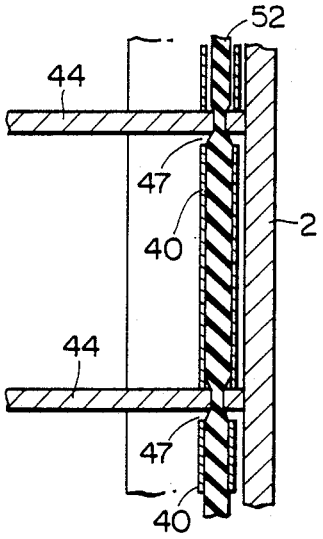
Figure 17:
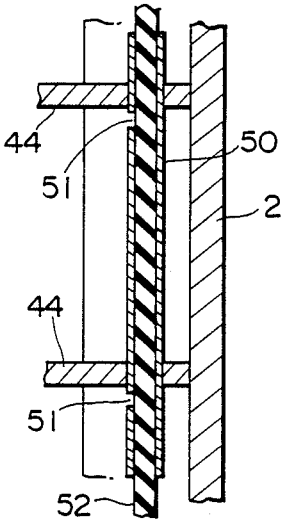

FIGS. 16 and 17 show a plugging apparatus for closing the communication of chambers 42 after a prescribed amount of water is supplied in the chambers 42. The apparatus comprises an elongated elastic tubular member 52 having an inlet (not shown). The tubular member 52 is smaller in diameter than the inner space within the tubular member 40 and the feed water line 50 while it is not inflated and expands in diameter when inflated so that the diameter thereof becomes larger than the inner diameter of the tubular member 40 and the feed water line 52 closing the gap 47 or the regulation aperture 51.

When using the plugging apparatus, water is poured in the vibration restraining apparatus 1 and a prescribed amount of water is distributed to each chamber according to a procedure as above-mentioned. Then, the plugging apparatus is inserted in the tubular members 40 or the feed water line 50 as it is not inflated. Then the elastic tubular member 52 is inflated to closely come in contact with an inner surface of the tubular members 40 or the feed water line 50. At a same time, the elastic tubular member 52 plugs the gaps 47 or the regulation apertures 51. Therefore, water retained in the chambers is refrained from moving to the other chambers and to be evaporated. Thus, a reliability of the system is increased.

Figure 18:
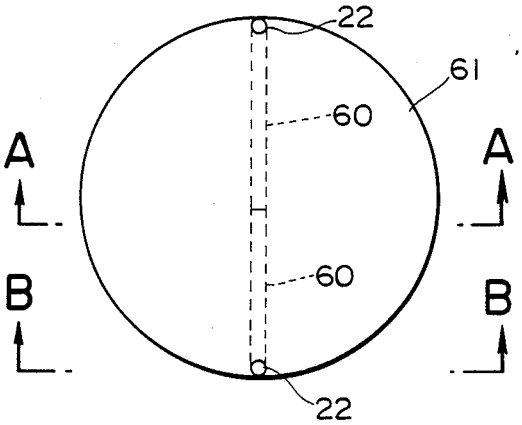
FIGS. 18 to 20 show a modified reservoir.

In a further modified embodiment shown in FIG. 18, separation wall 61 has a groove 60 formed in a lower surface thereof diametrically connecting a pair of pertures 22 formed at opposing edges of the all 61. Depth of the groove 60 increases gradually from center thereof to both edges. Therefore, bubbles captured in a chamber are lead by the groove 60 to the apertures 22 and evacuated therethrough.

Figure 19:
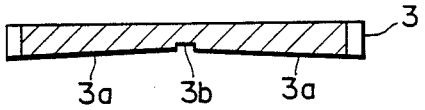
Figure 20:
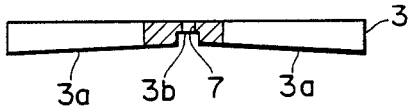

In a still modified embodiment shown in FIGS. 19 and 20, the upper surface of the plate 3 is flat and the thickness thereof decreases from edges to a groove 7 formed diametrically in the lower surface thereof. By virtue of this inclination of the lower surface, bubbles in the chamber can be gathered and evacuated more easily. In this embodiment also, depth of the groove increases from center thereof to the outer edges to lead the bubbles.

Figure 21:
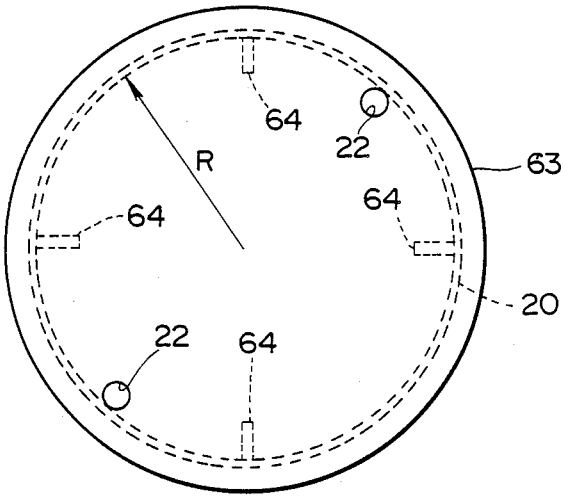
FIG. 21 shows a further modified reservoir.

FIG. 21 shows an embodiment wherein a plurality of flanges 64 are provided inside the chamber so as to obstacle the water flow in the chamber and increase damping coefficient of sloshing.

Operation of the embodiment will now be explained.

Figure 10:
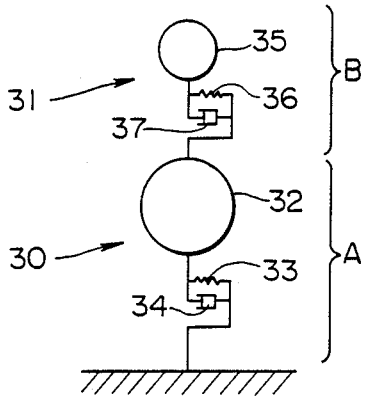
FIG. 10 is an oscillatory system modelizing a floor and a vibration restraining apparatus.

The floor structure including the equipments installed on the floor and the vibration restraining structure are modelized simply as shown in FIG. 10. Vibrational characteristics will be discussed hereinafter with reference to the model of FIG. 10 which is a so called two-degree-of-freedom oscillating system. A mass-spring-dashpot system 30 represents schematically vibrational characteristics of the floor structure. A mass 32, a spring 33 and a dashpot 34 represent effective mass, effective stiffness and effective damping of the mode, respectively, which are determined by the structural property of the floor structure and the weight of the equipments supported by the floor. A mass-spring-dashpot system 31 represent a certain mode of the vibration restraining structure, more specifically, sloshing characteristics of the liquid in the vibration restraining structure. A mass 35 and a spring 36 are determined by an effective mass and an effective spring of the sloshing which are functions of geometrical features of chambers in which the liquid is retained, depth of the liquid, and material of the liquid. Because these values are identical throughout chambers, effect of the sloshing in all the chambers is represented by a single mass-spring-dashpot system 31. Property of dashpot 37 is determined mainly by viscosity of the liquid and geometry of the reservoir.

As far as the effective weight of the liquid is lower than 2% of the effective weight of the floor structure, coupling effect on the natural frequencies of the floor structure and sloshing is negligible. Therefore, when the natural frequency of the floor structure coincides with that of sloshing, so does the natural frequency of the coupled two-degree-of-freedom system. Natural frequencies of sloshing Fs are determined as follows.

$$Fs = ks\ g\ \tanh(ks\ h)/2\ \mathrm{pi}$$

ks: (2n−1) pi/2a
n: order of the mode concerned
pi: ratio of a circumference to its diameter
2a: width of the tank in the direction of oscillation
g: gravity
h: depth of the water.

Natural frequency of the floor structure Fb is determined as follows.

$$Fbn = Kn/Mn/2\ \mathrm{pi}$$

wherein

Kn: modal stiffness of the floor structure
Mn: modal mass of the floor structure.

Therefore, it becomes possible to set a natural frequency of sloshing equal to the natural frequency of the floor structure by virtue of the above-mentioned equations.

Because the sloshing resonates with the vibration of the floor structure when the floor structure vibrates due to earthquakes etc. and the vibrational amplitude of the floor structure is reduced by virtue of the vibration restraining structure.

In the above explanation, vibrational characteristics of the floor structure was represented by the first mode and the effects of the vibration restraining structure were explained on the basis for a simplicity of explanation. But application of the vibration restraining structure is not restricted to restrain the first mode but the vibration restraining structure is also applicable to restrain any other modes. In such cases, the vibration restraining structure had better be installed where the floor structure displaces largely in the mode to be reduced. Consequently, the restraining structure is installed at an or at a plurality of intermediate floors.

Natural frequency of the floor structure differs naturally according to the mode. Therefore, geometry of the chamber retaining the liquid is determined so as to equate the sloshing natural frequency to the natural frequency of the floor structure of the concerned mode.

Further, because the vibration restraining structure according to the present invention is compact, the structure can be installed under any floor structure.

Because the vibration restraining structure contains a considerable amount of liquid, the structure is effective as a sound insulation floor and a fireproof floor also.

EXAMPLES

Figure 1:
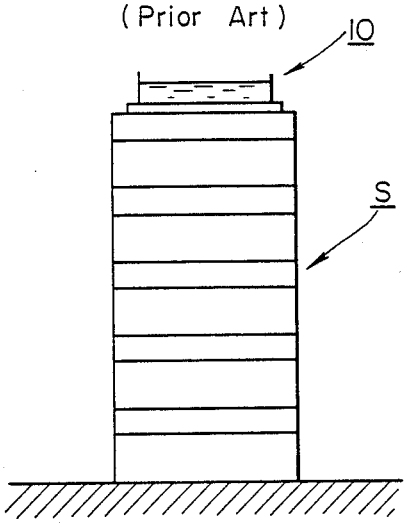
FIG. 1 (Prior Art)
FIG. 1 shows a conventional vibration restraining apparatus.

Effects of the vibration restraining structure of the present invention have been verified by earthquake response analyses of floor structures with and without the vibration restraining structure. The structure for analyses is a 5-story floor structure model and a vibration restraining structure located at the top of the floor structure as shown in FIG. 1. The building model has a mass of 400 kg at each floor. First natural period (reciprocal of first natural frequency) of the floor structure is 0.41 seconds. Total effective weight of the liquid is 52 kg and the first sloshing period thereof is 0.41 seconds.

Figure 12:
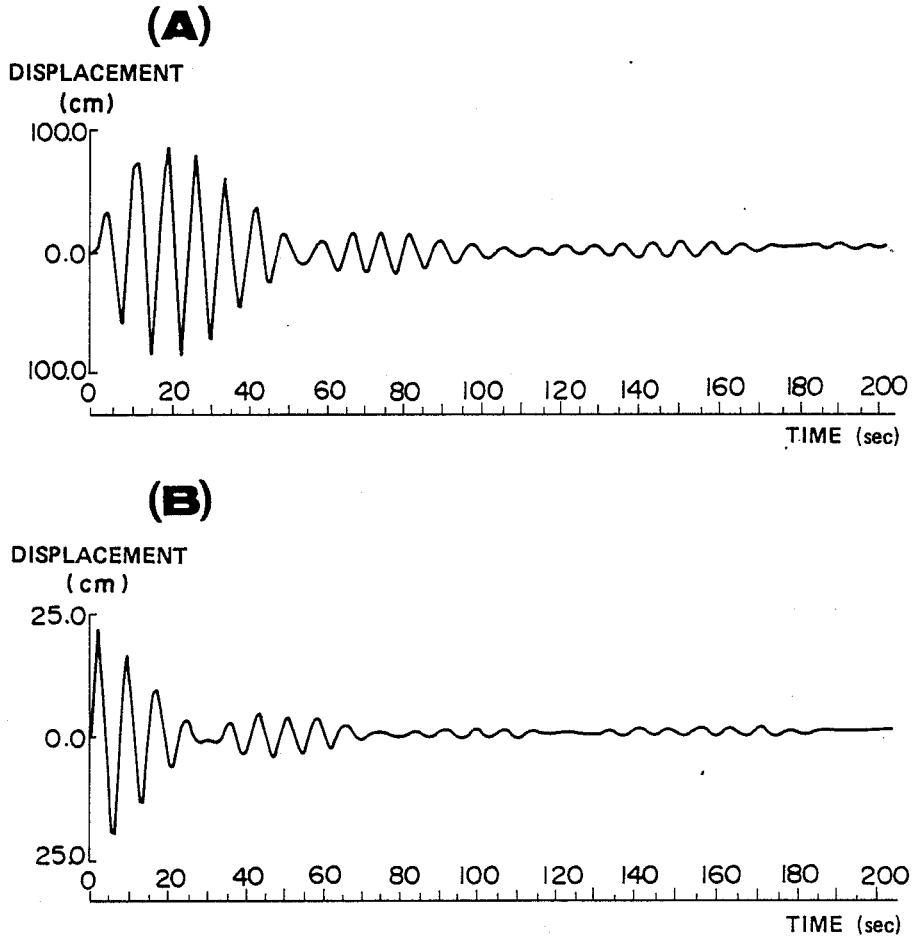
FIGS. 12 (A) and (B) show vibration time histories calculated for a floor with and without a vibration restraining apparatus.

FIG. 12(A) shows a displacement time history at the fourth mass from bottom of the floor structure without the vibration restraining structure responsive to the El Centro (NS) earthquake record. FIG. 12(B) shows a corresponding time history of the floor structure provided with the vibration restraining structure. Comparison of the earthquake responses elucidates that the response displacement of the floor structure is reduced by virtue of a vibration restraining structure. Yet, vibration stabilizes more rapidly when the floor structure is provided with the restraining structure.

Further analytical study shows that the effect of the vibration restraining structure is distinct when the effective mass of sloshing is larger than 0.5% of the effective mass of the floor structure. It is also shown that when the effective mass of sloshing exceeds 2% of that of the floor structure, natural frequency of the coupled system becomes different from the uncoupled structures and the vibration restraining effect decreases. In such cases, it is required to adjust sloshing frequency taking into account of the coupling effect of the structures. When the sloshing natural frequency is correctly adjusted, the vibration restraining effect can be obtained also in these cases.

Figure 11:
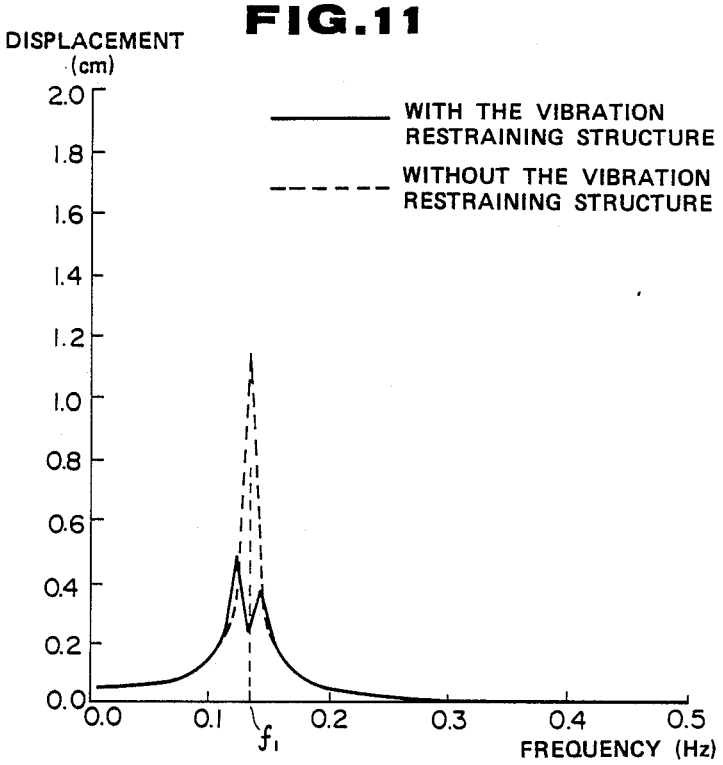
FIG. 11 shows transfer functions of a floor with and without a vibration restraining apparatus.

FIG. 11 shows a Fourier spectrum of the response time histories. When the floor structure is not provided with the apparatus, the transfer function has a distinct peak which means that the floor structure magnifies a specific frequency component f1 contained in the input vibration source. On the contrary, in case wherein the floor is provided with a vibration restraining apparatus, the peak splits into to peaks and the height of the peaks is far lower than the distinct peak in the first case. As a result the area of the spectrum is smaller in the second case than in the first case. The results coincides with a characteristic observed in the time histories, that is, when the floor is provided with the apparatus, large response displacement in a form of a simple harmonic oscillation observed in the first case is reduced in the second case and as a result, amplitude of the response is much smaller in the second case than in the first case.

What is claimed is:

1. A vibration restraining apparatus for restraining vibrations in a floor structure of a building, wherein said floor structure is supported from structural members of said building, includes at least one floor panel, is loaded with equipment placed on said floor structure, and has a natural frequency independent of that of said building, said vibration restraining apparatus comprising:

(a) a reservoir means of prescribed dimensions;

(b) means for securing said reservoir means to said floor panel of said floor structure so that said reservoir means suspends therefrom; and (c) liquid retained in the reservoir means, having a prescribed depth and a free surface, and being characterized by a sloshing natural frequency in which said sloshing natural frequency of the liquid is made generally equal to a dry natural frequency of the floor structure, said dry natural frequency of the floor structure corresponding to a condition in which the reservoir means without the liquid and equipment are loaded on the floor structure.

2. A vibration restraining apparatus for a floor structure according to claim 1, wherein the reservoir means comprises:

(a) rectangular side wall members having an upper edge, lower edge and side edges, attached to each other at their side edges, attached to the floor at the upper edge;

(b) a bottom wall member attached to the lower edge of the side wall members, whereby defining a rectangular parallelepiped inner space to retain the liquid.

3. A vibration restraining apparatus for a floor structure according to claim 2, wherein the reservoir means further comprises separation walls disposed in said inner space for separating the inner space into a plurality of chambers of prescribed dimensions, the liquid is retained in each chamber, and the liquid in the chambers has a prescribed depth and a free surface.

4. A vibration restraining apparatus for a floor structure according to claim 3, wherein said separation walls comprise at least one vertical separation wall disposed vertical in said inner space and has at least one communication hole provided beneath said free surface of said liquid through which adjacent chambers are communicating to each other.

5. A vibration restraining apparatus for a floor structure according to claim 3 wherein, geometry of said chambers and depth of liquid retained in the chambers are identical as to all of said chambers so that a sloshing natural frequency of the liquid coincides with a natural frequency of said floor structure.

6. A vibration restraining apparatus for a floor structure according to claim 3 which further comprises a liquid feeding means for feeding liquid to said chambers and a liquid draining means for draining liquid from the chambers.

7. A vibration restraining structure for a floor structure according to claim 3, wherein a sloshing natural frequency in a longitudinal direction generally coincides with a natural frequency of the floor structure in the longitudinal direction and a natural sloshing frequency in a transverse direction generally coincides with a natural frequency of the floor structure in the transverse direction.

8. A vibration restraining apparatus for restraining vibrations in a floor structure of a building, wherein said floor structure is supported from structural members of said building, is loaded with equipment placed on said floor structure, and has a natural frequency independent of that of said building, said vibration restraining apparatus comprising:

(a) a reservoir means of prescribed dimensions secured to the floor structure; and (b) liquid retained in the reservoir means, having a prescribed depth and a free surface, and being characterized by a sloshing natural frequency in which said sloshing natural frequency of the liquid is made generally equal to a dry natural frequency of the floor structure, said dry natural frequency of the floor structure corresponding to a condition in which the reservoir means without the liquid and said equipment are loaded on the floor structure, said reservoir means including (i) rectangular side wall members having an upper edge, lower edge and side edges, attached to each other at their side edges, attached to the floor at the upper edge; and (ii) a bottom wall member attached to the lower edge of the side wall members, whereby defining a rectangular parallelepiped inner space to retain the liquid, wherein a plurality of cylindrical walls, having upper end and lower end, are provided in said rectangular parallelepiped inner space so that the upper end touches said floor and the lower end touches said bottom wall, the cylindrical walls defining respective cylindrical inner spaces, the cylindrical walls are in contact to each other to form a generally quadrilateral prismatic space thereby, each cylindrical wall being in contact with a pair of said side walls tangentail thereto and intersecting to each other to form a generally triangular prismatic space therebetween, whereby said liquid is retained in the cylindrical inner spaces.

9. A vibration restraining apparatus for a floor structure according to claim 8, wherein at least one separation wall is provided in said rectangular parallelepiped inner space so as to divide the cylindrical inner spaces into chambers, and said liquid is retained in each of the chambers.

10. A vibration restraining apparatus for a floor structure according to claim 9, wherein first slits are formed in each of said cylindrical walls at a lower part of each chamber so that said chamber communicates with said generally quadrilateral prismatic space therethrough, second slits are formed in said cylindrical walls at an upper part of each chamber so that the chamber communicates with said triangular prismatic space, and a feed water means is provided for supplying water to the triangular prismatic space.

11. A method restraining vibrations in a floor structure supported from structural members of a building and including at least one floor panel, said floor structure being loaded with equipment placed thereon and having a natural frequency independent of that of said building, said method comprising the steps of:

(a) providing a reservoir means having prescribed dimensions and being capable of retaining a liquid;

(b) securing said reservoir means to said floor panel of said floor structure so that said reservoir means suspends therefrom; and (c) providing said reservoir means with a prescribed amount of liquid so that the liquid has a prescribed depth, a free surface at a top thereof, and is characterized by a sloshing natural frequency in which said natural frequency of said building is made generally equal to a dry natural frequency of the floor structure, wherein said dry natural frequency of said floor structure corresponds to a condition in which said reservoir means without said liquid and equipment are loaded on said floor structure.

12. The method according to claim 11, wherein said floor structure includes a plurality of said floor panels, and wherein step (a) comprises providing a plurality of said reservoir means, step (b) comprises securing each said reservoir means to one of said floor panels, and step (c) comprises providing each said reservoir means with a prescribed amount of liquid so that said liquid has a prescribed depth, a free surface at the top thereof, and is characterized by a sloshing natural frequency in which said sloshing natural frequency is made generally equal to a dry natural frequency of said floor structure without said liquid and equipment being loaded on said floor structure.

13. The method according to claim 11 wherein said floor structure has longitudinal and transversal natural frequencies, and said liquid is further characterized by longitudinal and transversal sloshing natural frequencies which generally coincide with said longitudinal and transversal natural frequencies of said floor structure, respectively.

14. A vibration restraining floor structure having a natural frequency independent of that of said building, and being capable of supporting equipment, said vibration restraining floor structure comprising:

(a) a floor panel;

(b) a reservoir means of prescribed dimensions and being attached to said floor panel to be suspended from said floor panel; and (c) liquid retained in said reservoir means, having a prescribed depth and a free surface, and being characterized by a sloshing natural frequency in which said sloshing natural frequency of the liquid is made generally equal to a dry natural frequency of said floor structure, said dry natural frequency of said floor structure corresponding to a condition in which said reservoir means without said liquid and equipment are loaded on said floor structure.

15. The vibration restraining floor structure according to claim 14, wherein the reservoir means comprises:

(a) rectangular side wall members having an upper edge, lower edge and side edges, attached to each other at their side edges, and being attached to the floor at the upper edge;

(b) a bottom wall member attached to the lower edge of the side wall members, whereby defining a rectangular parallelopiped inner space to retain the liquid.

16. The vibration restraining floor structure according to claim 15, wherein the reservoir means further comprises separation walls disposed in said inner space for prescribed dimensions, the liquid is retained in each chamber, and the liquid in the chambers has a prescribed depth and a free surface.

17. The vibration restraining floor structure according to claim 16, wherein the separation walls comprise at least one vertical separation wall disposed vertical in said inner space and has at least one communication hole provided beneath said free surface of said liquid through which adjacent chambers are communicating to each other.

18. The vibration restraining floor structure according to claim 19, wherein geometry of the chambers and depth of liquid retained in the chambers are identical as to all of said chambers so that a sloshing natural frequency of the liquid coincides with a natural frequency of said floor structure.

19. The vibration restraining floor structure according to claim 16 which further comprises a liquid feeding means for feeding liquid to said chambers and a liquid draining means for draining liquid from the chambers.

20. The vibration restraining floor structure according to claim 15, the floor structure further comprises a plurality of cylindrical wall, having an upper end and lower end, in said inner space so that the upper end touches said bottom wall, the cylindrical walls defining respective cylindrical inner spaces, the cylindrical walls are in contact to each other to form a generally quadrilateral prismatic space thereby each cylindrical wall being in contact with a pair of said side walls tangential thereto and said side walls intersecting each other to form a generally triangular prismatic space therebetween, whereby said liquid is retained in the cylindrical inner spaces.

21. The vibration restraining floor structure according to claim 20, wherein at least one separation wall is provided in said rectangular parallelopiped inner space so as to divide the cylindrical inner spaces into chambers, and said liquid is retained in each of the chambers.

* * * * *

UNITED STATES PATENT AND TRADEMARK OFFICE

CERTIFICATE OF CORRECTION

PATENT NO. : 4,924,639

DATED : May 15, 1990

INVENTOR(S) : Takanori Sato and Kazumitsu Takanashi

It is certified that error appears in the above-identified patent and that said Letters Patent is hereby corrected as shown below:

Col. 2, line 50 - after "(a)" delete "a prescribed dimensions and secured to the floor structure;" and insert therefor --a reservoir means of prescribed dimensions;--

Column 5, line 53 - delete the word "still".

UNITED STATES PATENT AND TRADEMARK OFFICE

CERTIFICATE OF CORRECTION

PATENT NO. : 4,924,639

DATED : May 15, 1990

INVENTOR(S) : Takanori Sato et al

It is certified that error appears in the above-identified patent and that said Letters Patent is hereby corrected as shown below:

Column 5, line 56 - change the word "abovementioned" to --above-mentioned--.

Column 7, line 2 - change the word "all" to --wall--.

Signed and Sealed this

Fifteenth Day of September, 1992

*Attest:*

DOUGLAS B. COMER

*Attesting Officer*

*Acting Commissioner of Patents and Trademarks*